US011612239B2

(12) United States Patent
Liu

(10) Patent No.: US 11,612,239 B2
(45) Date of Patent: Mar. 28, 2023

(54) TABLE HEIGHT ADJUSTMENT MECHANISM

(71) Applicant: Zhuhai Shichang Metals Ltd., Zhuhai (CN)

(72) Inventor: Jingbo Liu, Zhuhai (CN)

(73) Assignee: Zhuhai Shichang Metals Ltd., Zhuhai (CN)

( * ) Notice: Subject to any disclaimer, the term of this patent is extended or adjusted under 35 U.S.C. 154(b) by 62 days.

(21) Appl. No.: 17/375,544

(22) Filed: Jul. 14, 2021

(65) Prior Publication Data

US 2023/0013711 A1 Jan. 19, 2023

(51) Int. Cl.
*A47B 9/20* (2006.01)

(52) U.S. Cl.
CPC ..... *A47B 9/20* (2013.01)

(58) Field of Classification Search
CPC .. A47B 9/14; A47B 9/20; A47B 9/145; A47B 2003/145; A47B 2009/145; A47B 3/0818; A47B 3/0913
USPC ..... 108/147.21, 147.19, 133, 131
See application file for complete search history.

(56) References Cited

U.S. PATENT DOCUMENTS

| | | | | |
|---|---|---|---|---|
| 2,875,007 | A * | 2/1959 | Fox | A47B 9/14 248/188.5 |
| 2,999,729 | A * | 9/1961 | Semmelroth | A47B 9/14 108/146 |
| 3,027,209 | A | 3/1962 | Nielsen | |
| 3,410,232 | A * | 11/1968 | Bills | A47B 9/14 108/146 |
| 4,974,871 | A * | 12/1990 | Mao | B62B 3/02 280/655 |
| 5,499,426 | A * | 3/1996 | Hsieh | A45C 13/262 280/655 |
| 6,247,203 | B1 * | 6/2001 | Kuo | A45C 13/262 280/655 |
| 8,474,098 | B1 * | 7/2013 | Yang | A45C 13/262 16/113.1 |
| 10,470,561 | B2 | 11/2019 | Clegg et al. | |
| 10,939,751 | B1 * | 3/2021 | Chen | A47C 19/024 |
| 11,241,087 | B2 * | 2/2022 | Choi | A47B 83/024 |
| 11,291,297 | B2 * | 4/2022 | Chen | A47B 37/04 |

* cited by examiner

*Primary Examiner* — Jose V Chen
(74) *Attorney, Agent, or Firm* — Luedeka Neely Group PC

(57) ABSTRACT

A table includes collapsible telescopic legs and a height adjustment mechanism. The height adjustment mechanism includes a pair of latch arms and an activation device. When pushed downward, the activation device engages with the latch arms to cause the latch arms to move inward. The inward motion is opposed by a biasing mechanism disposed between the latch arms. As the latch arms move inward, tabs at the ends of the latch arms disengage from notches on the telescopic legs to allow the legs to be extended or retracted. When the activation device is released, the tabs engage with the notches to lock the legs at a selected height position.

17 Claims, 4 Drawing Sheets

TABLE HEIGHT ADJUSTMENT MECHANISM

FIELD

This invention relates to the field of furniture. More particularly, this invention relates to a height adjustment mechanism for a table or other structure having collapsible telescopic legs.

BACKGROUND

Tables with collapsible legs are useful because they provide the functionality of a table with compact storage ability. Some collapsible tables also include height adjustable telescopic legs to offer more utility with the various height settings.

Prior height adjustment mechanisms for tables have been complicated to use. Such mechanisms are inefficient due to the time the user must invest to understand and implement the functionality. A simple design is preferred that would encourage the user to utilize the different heights depending on the specific use of the table.

What is needed, therefore, is a collapsible table with a height adjustment mechanism having a straightforward and simple user function to make use of the table more accessible and easier. The present disclosure provides a height adjustment mechanism whose uncomplicated and effective design is easy to understand and operate for most users.

SUMMARY

The above and other needs are met by a height adjustment mechanism for structures having telescopic legs. Preferred embodiments of the height adjustment mechanism include a first latch arm, a second latch arm, and an activation device. The first and second latch arms are operable to slide between a first position and a second position. The first latch arm includes a first tab disposed at its outer end and a first sloped surface disposed adjacent its inner end. The first tab engages with a first notch on the first telescopic leg when the first latch arm is in the first position, and disengages from the first notch on the first telescopic leg when the first latch arm is in the second position. The second latch arm includes a second tab disposed at its outer end and a second sloped surface disposed adjacent its inner end. The second tab engages with a second notch on the second telescopic leg when the second latch arm is in the first position, and disengages from the second notch on the second telescopic leg when the second latch arm is in the second position.

The activation device includes first and second contact surfaces that are disposed adjacent the first and second sloped surfaces of the first and second latch arms. As the activation device is pressed, the first contact surface slidingly engages the first sloped surface and the second contact surface slidingly engages the second sloped surface, thereby causing the first and second latch arms to slide inward from the first position to the second position.

In some embodiments, the first and second sloped surfaces are shaped such that a downward vertical displacement of the first and second contact surfaces in engagement with the first and second sloped surfaces causes the first and second latch arms to move inward in a lateral direction.

In some embodiments, the height adjustment mechanism includes a cross-brace tube that is laterally disposed between the first and second telescopic legs. The first and second latch arms are disposed within the cross-brace tube, such that the cross-brace tube acts as a guide in which the first and second latch arms slide between the first and second positions.

In some embodiments, the height adjustment mechanism includes a biasing mechanism, such as a spring, that is disposed between and attached to the inner ends of the first and second latch arms. The biasing mechanism urges the inner ends of the first and second latch arms laterally away from each other.

In some embodiments, the height adjustment mechanism includes a guide case that at least partially encloses and guides movement of the activation device and the first and second sloped surfaces of the first and second latch arms. The guide case limits motion of the activation device to only vertical motion and limits motion of the first and second latch arms to only horizontal lateral motion.

In some embodiments, the height adjustment mechanism includes one or more fasteners that secure the guide case to the cross-brace tube.

In some embodiments, the activation device comprises a molded plastic button having a substantially hollow interior.

In some embodiments, the first and second contact surfaces of the activation device comprise molded plastic surfaces disposed within the interior of the molded plastic button.

In some embodiments, the first and second contact surfaces of the activation device comprise cylindrical metal pins disposed within the interior of the molded plastic button.

In another aspect, embodiments of the invention are directed to a telescopic leg assembly having multiple selectable height positions. The telescopic leg assembly includes first and second telescopic legs. The first telescopic leg includes a first upper leg portion and a first lower leg portion that slides within the first upper leg portion in a telescopic arrangement. The first lower leg portion has first notches that correspond to the multiple selectable height positions. The second telescopic leg includes a second upper leg portion and a second lower leg portion that slides within the second upper leg portion in a telescopic arrangement. The second lower leg portion has second notches that correspond to the multiple selectable height positions. A cross-brace tube is laterally disposed between and connects the first upper leg portion of the first telescopic leg and the second upper leg portion of the second telescopic leg. Disposed within the cross-brace tube is a height adjustment mechanism as described above.

In another aspect, embodiments of the invention are directed to a table having a tabletop and a telescopic leg assembly having multiple selectable height positions. The telescopic leg assembly is pivotally connected to the tabletop and is movable from a use position in which the telescopic leg assembly is perpendicular to the tabletop and a storage position in which the telescopic leg assembly is parallel to the tabletop. The telescopic leg assembly includes first and second telescopic legs and a cross-brace tube laterally disposed between the first and second telescopic legs. Disposed within the cross-brace tube is a height adjustment mechanism as described above.

BRIEF DESCRIPTION OF THE DRAWINGS

Other embodiments of the invention will become apparent by reference to the detailed description in conjunction with the figures, wherein elements are not to scale so as to more clearly show the details, wherein like reference numbers indicate like elements throughout the several views, and wherein.

DETAILED DESCRIPTION

With reference to the drawings, the disclosure relates to a height adjustment mechanism for tables and other structures having telescopic legs. Such tables typically have tabletops made from plastic and legs made from metal and are designed for temporary use and storage. Although the height adjustment mechanism described herein is applicable for use in such tables, the device is also suitable for adjusting the height of any object that contains collapsible telescopic legs. For example, the height adjustment mechanism could be used to change the height of a bench, chair or computer stand.

Prior height adjusting devices have required two hands to activate the device or a particular grip or combination of movements to achieve adjustment. Preferred embodiments of the device described herein require only the use of one hand to activate a single button through a singular downward motion, leaving the user's other hand free to guide the legs or provide stability.

Figure 1:
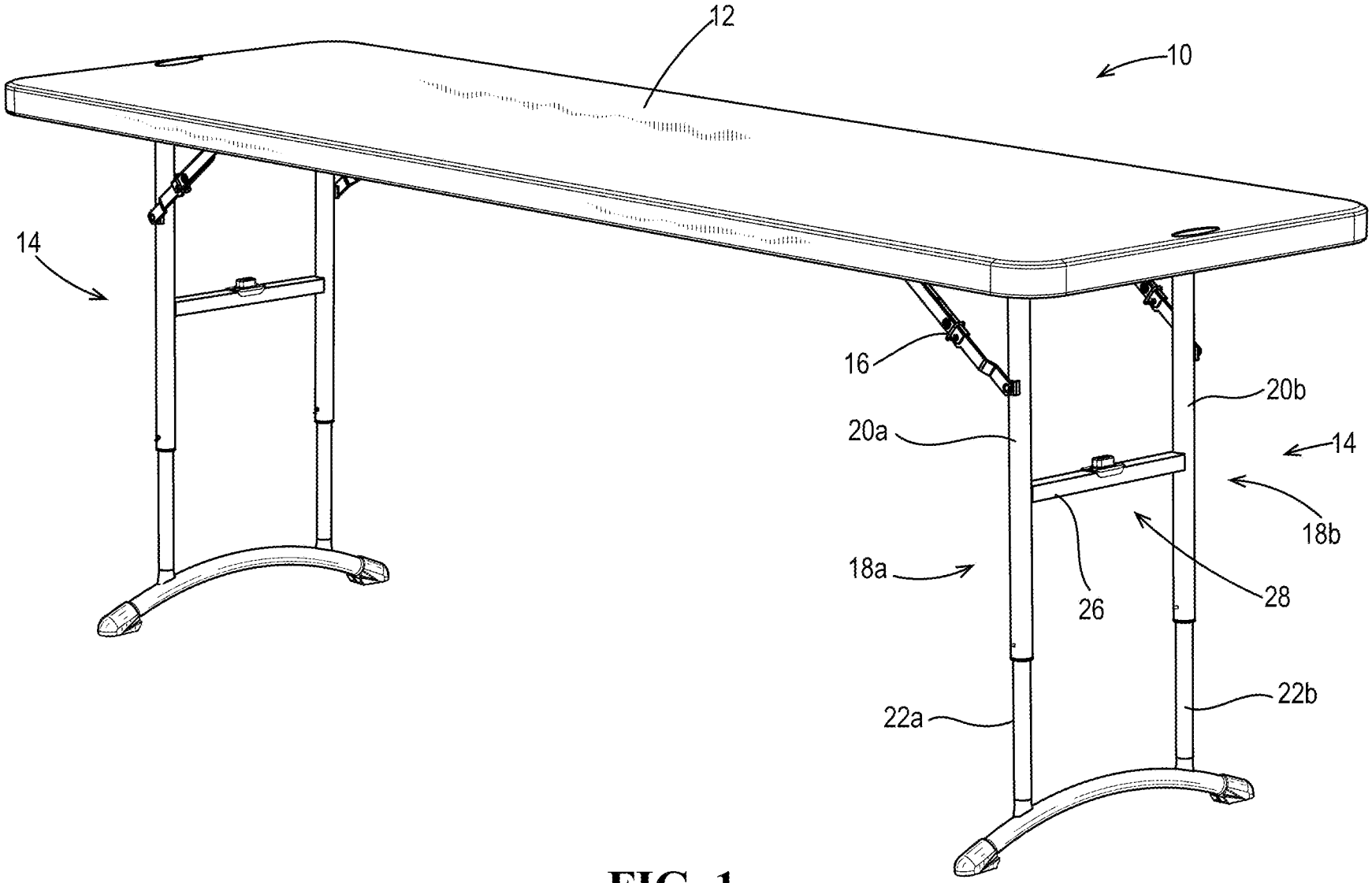
FIG. 1 depicts a table having collapsible and height-adjustable legs according to an embodiment of the invention.
Figure 2A:
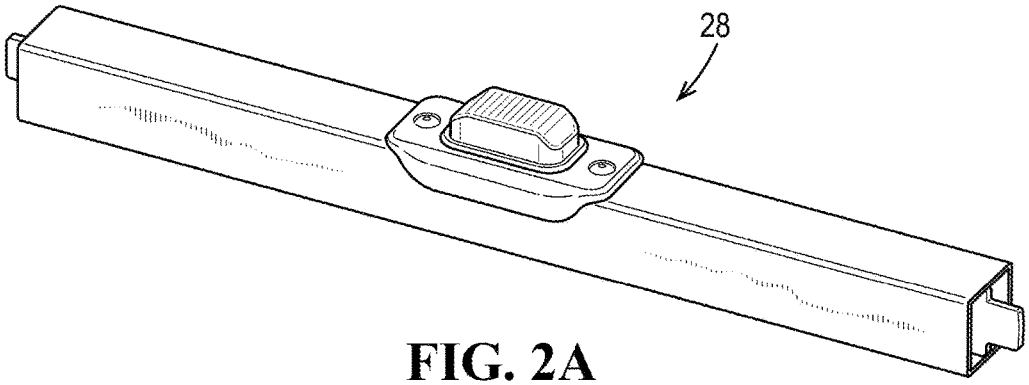
FIG. 2A depicts a height adjustment mechanism according to an embodiment of the invention.
Figure 2B:
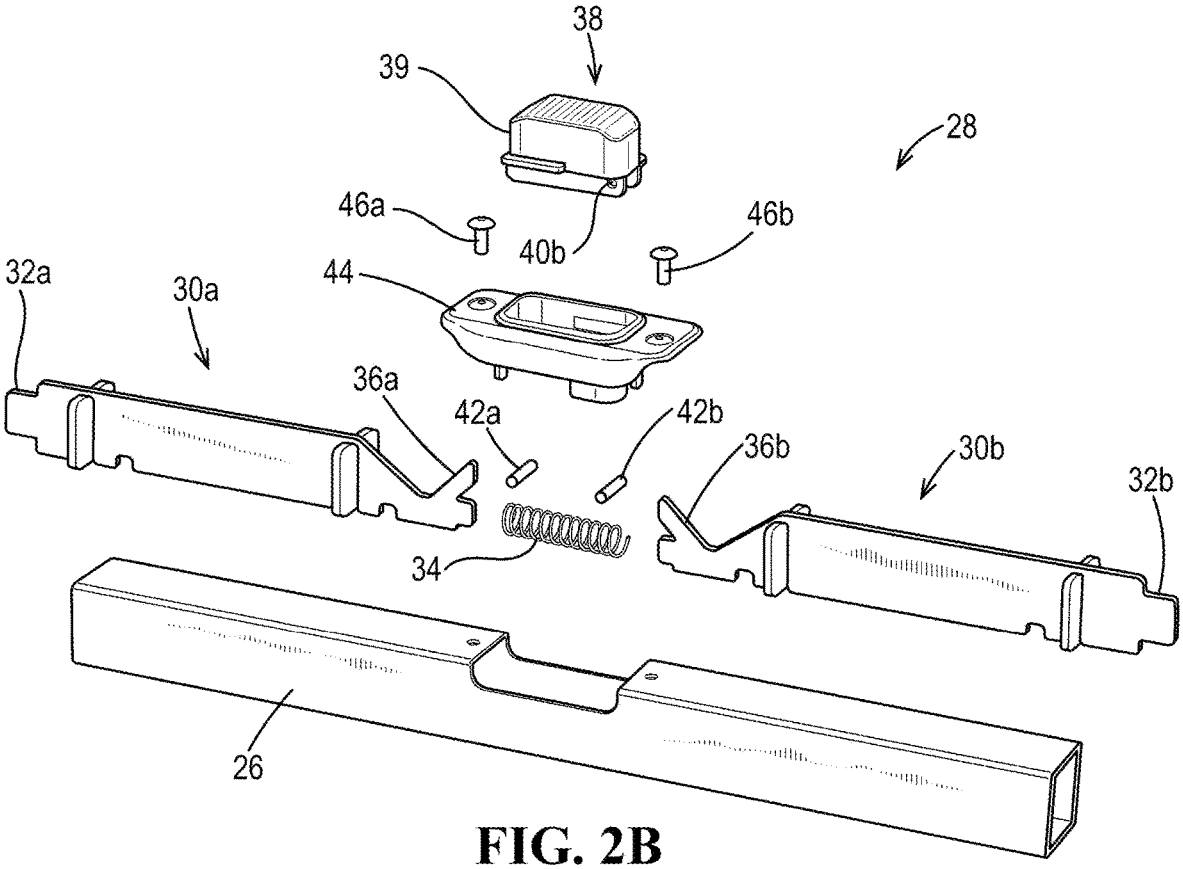
FIG. 2B depicts an exploded view of the height adjustment mechanism of FIG. 2A.

As shown in FIG. 1, a preferred embodiment of a collapsible table 10 includes a plastic tabletop 12 that is supported by metal leg assemblies 14 that extend downward from the tabletop. The leg assemblies 14 are rotatably connected to the tabletop 12 so that they may be rotated between a use position (as shown in FIG. 1) in which the leg assemblies 14 are perpendicular to the tabletop 12 and a storage position in which the leg assemblies 14 are parallel to and disposed against the bottom of the tabletop 12. The leg assemblies 14 are telescopic, which allows for adjusting the height of the tabletop 12 when in the use position. The leg assemblies 14 are held in the use position by articulating support braces 16 that collapse against the bottom of the tabletop in parallel with the legs 14 when in the storage position.

Each of the leg assemblies 14 includes first and second telescopic legs 18*a*-18*b* each containing an upper leg portion 20*a*-20*b* and a lower leg portion 22*a*-22*b* in a telescopic arrangement that provides for multiple height positions. The upper leg portions 20*a*-20*b* and lower leg portions 22*a*-22*b* are positioned such that the lower leg portions 22*a*-22*b* can slide within the tubular interior of the upper leg portions 20*a*-20*b*. The upper leg portions 20*a*-20*b* and lower leg portions 22*a*-22*b* are oriented such that the table 10 is at its maximum height when the lower leg portions 22*a*-22*b* are at fully extended positions with respect to the upper leg portions 20*a*-20*b*, and the table 10 is at its minimum height when the lower leg portions 22*a*-22*b* are fully retracted within the upper leg portions 20*a*-20*b*. The lower leg portions 22*a*-22*b* have multiple notches 24 spaced apart at various vertical positions that correspond to different height positions (shown in FIGS. 3A-3B).

As depicted in FIG. 1, each of the leg assemblies 14 is laterally supported by a metal cross-brace tube 26 disposed between the upper leg portions 20*a*-20*b*. Each of the cross-brace tubes 26 encloses a height adjustment mechanism 28 for the adjustment of the height of the telescopic leg assemblies 14 when the table is in the use position.

As depicted in FIGS. 2A-2B and 3A-3C, a preferred embodiment of the height adjustment mechanism 28 includes two latch arms 30*a*-30*b* disposed within the cross-brace tube 26 that connects at each end to the opposing upper leg portions of the leg assemblies 14. The outer ends of the latch arms 30*a*-30*b* include tabs 32*a*-32*b* that engage with corresponding sets of notches 24 on the lower leg portions of the leg assemblies 14 that correspond to a selectable height of the tabletop. When the tabs 32*a*-32*b* of the latch arms engage a selected set of notches 24 on the lower leg portions of the leg assemblies 14, they lock the height at the selected position.

The inner ends of the latch arms 30*a*-30*b* are connected to a biasing mechanism 34 that urges the inner ends of the latch arms 30*a*-30*b* away from each other. In a preferred embodiment, the biasing mechanism 34 is a cylindrical spring. At the inner ends of the latch arms 30*a*-30*b* are sloped surfaces 36*a*-36*b* that are angled such that the downward motion of an activation device 38 causes a proportional lateral displacement of the latch arms 30*a*-30*b*.

The cross-brace tube 26 houses the latch arms 30*a*-30*b* and the biasing mechanism 34, encasing them on all sides. The cross-brace tube 26 also provides lateral support for the table 10 and a protective covering for the components of the mechanism 28. Further, the metal cross-brace tube 26 limits the motion of the latch arms 30*a*-30*b* strictly to lateral horizontal motion.

Figure 4B:
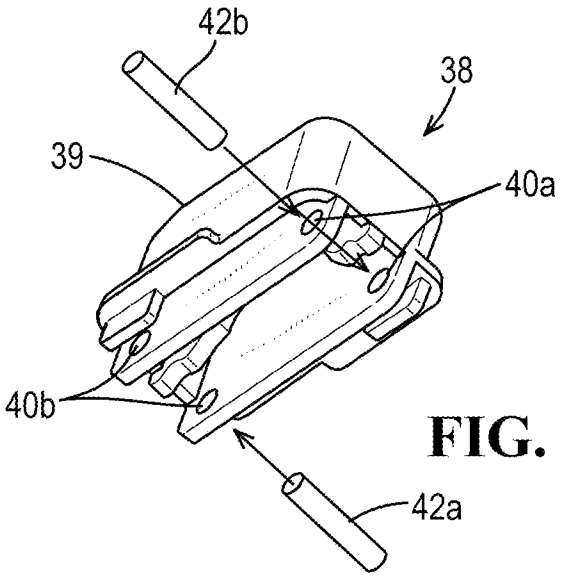
FIGS. 4A and 4B depict an activation device of the height adjustment mechanism according to an embodiment of the invention.
Figure 4A:
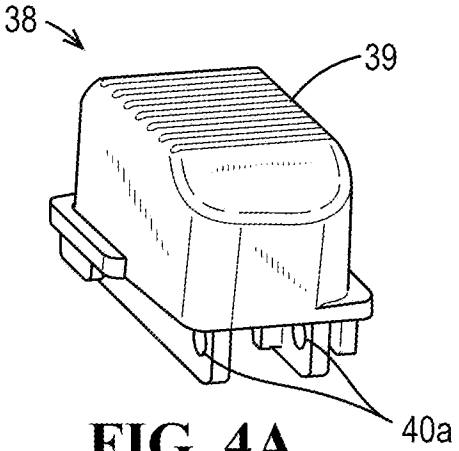

The activation device 38 is preferably disposed adjacent to the top of the sloped surfaces 36*a*-36*b* at the inner ends of the latch arms 30*a*-30*b*. At the bottom of a preferred embodiment of the activation device 38 are two contact surfaces 42*a*-42*b* that directly engage the sloped surfaces 36*a*-36*b* at the inner ends of the latch arms 30*a*-30*b*. In a preferred embodiment depicted in FIGS. 4A-4B, the activation device 38 comprises an injection-molded button 39 having two pairs of opposing apertures 40*a*-40*b*, and the contact surfaces 42*a*-42*b* are metal pins held in the opposing apertures 40*a*-40*b*. As the activation device 38 is pressed downward, the contact surfaces 42*a*-42*b* slide or rotate along the sloped surfaces 36*a*-36*b*.

Figure 5B:
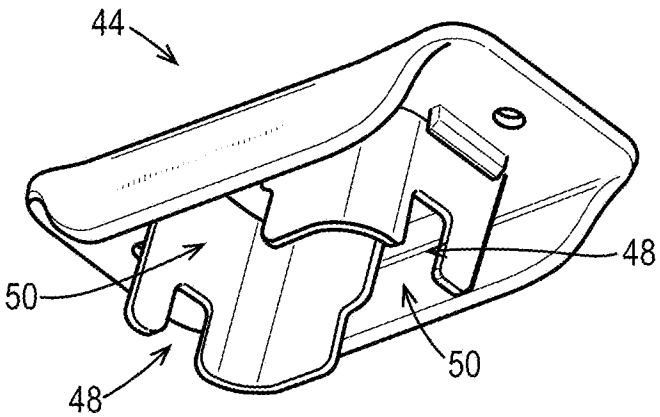
FIGS. 5A and 5B depict a guide case of the height adjustment mechanism according to an embodiment of the invention.
Figure 5A:
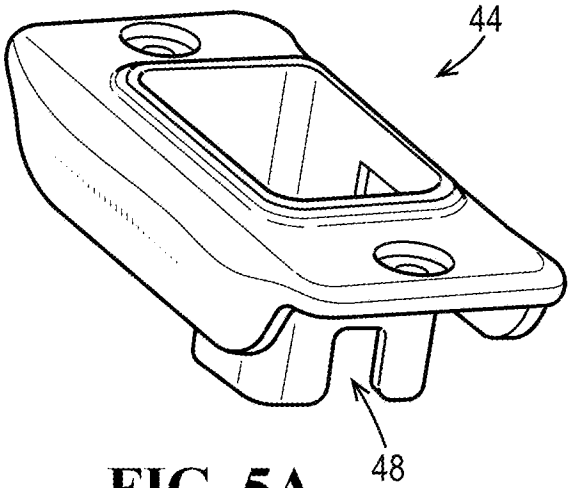

FIGS. 5A-5B depict a preferred embodiment of a guide case 44 for the activation device 38. In the preferred embodiment, the guide case 44 surrounds the activation device 38 and limits its motion to substantially the vertical direction, thereby impeding horizontal motion that may result in wobble as the activation device 38 is pressed. The preferred embodiment of the guide case 44 is an injection-molded frame having molded slots 50 that engage with corresponding molded features on the button 39 to guide the button as it moves up and down when pressed and released. The guide case 44 also preferably includes holes for receiving fasteners 46*a*-46*b* that secure the guide case 44 to the cross brace tube 26. The preferred embodiment of the guide case 44 also has a pair of opposing slots 48 that receive and guide the first and second latch arms 30*a*-30*b*, thereby limiting the motion of the first and second latch arms 30*a*-30*b* to horizontal lateral motion between the first and second positions.

Figures 3A, 3B, 3C:
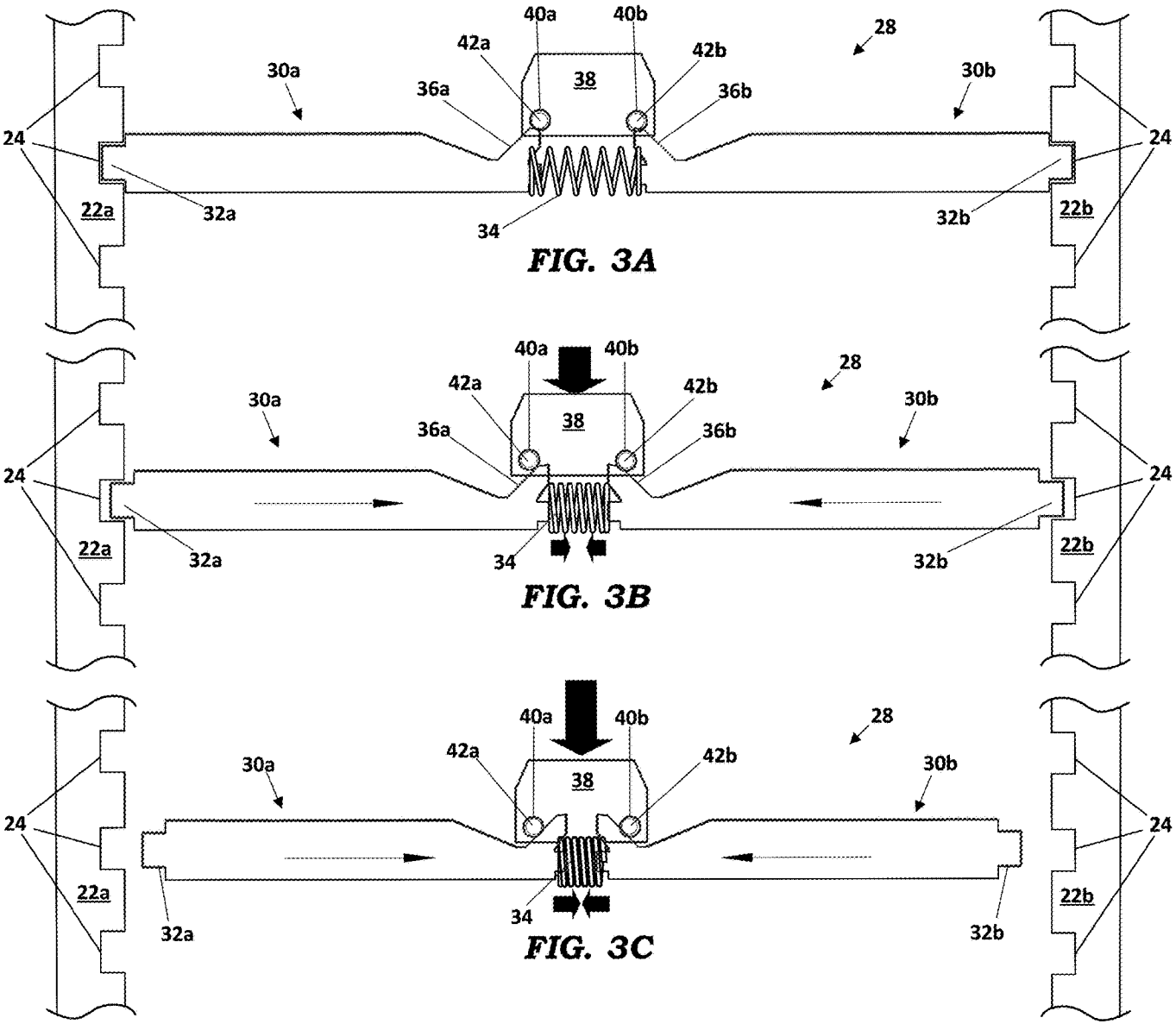
FIG. 3A depicts a height adjustment mechanism in a first position according to an embodiment of the invention.
FIG. 3B depicts the height adjustment mechanism in a second position according to an embodiment of the invention.
FIG. 3C depicts the height adjustment mechanism in a third position according to an embodiment of the invention.

When the activation device 38 is not pressed, as depicted in FIG. 3A, the tabs 32*a*-32*b* at the ends of the latch arms 30*a*-30*b* engage a pair of the notches 24 on the opposing lower leg portions 22*a*-22*b* of the telescopic leg assemblies 14 to prevent their vertical movement. When the activation device 38 is pressed downward, as depicted in FIGS. 3B and 3C, the contact surfaces 42*a*-42*b* within the activation device 38 move downward along the sloped surfaces 36*a*-36*b* of the latch arms 30*a*-30*b*. As the contact surfaces 42*a*-42*b* move downward, they provide an inward force on the sloped surfaces 36*a*-36*b* of the latch arms 30*a*-30*b*, thereby causing the latch arms 30*a*-30*b* to move inward against the force of the biasing mechanism 34. As the latch arms 30*a*-30*b* move inward, the tabs 32*a*-32*b* disengage from the notches 24 on the lower leg portions 22*a*-22*b*, thereby allowing the telescopic leg assemblies 14 to be extended or retracted.

When the user releases the activation device 38, the outward force of the biasing mechanism 34 pushes the latch arms 30*a*-30*b* outward, and the outward moving sloped surfaces 36*a*-36*b* push the contact surfaces 42*a*-42*b* up vertically in proportion to the horizontal motion of the sloped surfaces 36*a*-36*b*.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A height adjustment mechanism for a structure having opposing first and second telescopic legs, the height adjustment mechanism comprising:

a first latch arm that is operable to slide between a first position and a second position, the first latch arm having an inner end and an outer end, the first latch arm including a first tab disposed at the outer end and a first sloped surface disposed adjacent the inner end, wherein the first tab is operable to engage with a first notch on the first telescopic leg when the first latch arm is in the first position, and to disengage from the first notch on the first telescopic leg when the first latch arm is in the second position;

a second latch arm that is operable to slide between a first position and a second position, the second latch arm having an inner end and an outer end, the second latch arm including a second tab disposed at the outer end and a second sloped surface disposed adjacent the inner end, wherein the second tab is operable to engage with a second notch on the second telescopic leg when the second latch arm is in the first position, and to disengage from the second notch on the second telescopic leg when the second latch is in the second position;

a spring disposed between and attached to the inner ends of the first and second latch arms, wherein the spring provides an outward force that urges the first and second latch arms laterally away from each other when the spring is compressed; and an activation device disposed adjacent the first and second sloped surfaces of the first and second latch arms, the activation device comprising:

a first contact surface that slidingly engages the first sloped surface, thereby causing the first latch arm to slide inward from the first position to the second position; and a second contact surface that slidingly engages the second sloped surface, thereby causing the second latch arm to slide inward from the first position to the second position.

2. The height adjustment mechanism of claim 1, wherein the first and second sloped surfaces are shaped such that a downward vertical displacement of the first and second contact surfaces in engagement with the first and second sloped surfaces causes the first and second latch arms to move inward in a lateral direction.

3. The height adjustment mechanism of claim 1 further comprising a cross-brace tube laterally disposed between the first and second telescopic legs, wherein the first and second latch arms are disposed within the cross-brace tube, such that the cross-brace tube acts as a guide in which the first and second latch arms slide between the first and second positions.

4. The height adjustment mechanism of claim 3, further comprising a guide case attached to the cross-brace tube, wherein the guide case at least partially encloses and guides movement of the activation device and the first and second latch arms, and wherein the guide case limits motion of the activation device to only vertical motion and limits motion of the first and second latch arms to only horizontal lateral motion.

5. The height adjustment mechanism of claim 4 further comprising one or more fasteners that secure the guide case to the cross-brace tube.

6. The height adjustment mechanism of claim 1 wherein the activation device comprises a molded plastic button having a substantially hollow interior.

7. The height adjustment mechanism of claim 6 wherein the first and second contact surfaces of the activation device comprise molded plastic surfaces disposed within the interior of the molded plastic button.

8. The height adjustment mechanism of claim 6 wherein the first and second contact surfaces of the activation device comprise cylindrical metal pins disposed within the interior of the molded plastic button.

9. A telescopic leg assembly having multiple selectable height positions, the telescopic leg assembly comprising:

a first telescopic leg comprising a first upper leg portion and a first lower leg portion that slides within the first upper leg portion in a telescopic arrangement, the first lower leg portion having first notches that correspond to the multiple selectable height positions;

a second telescopic leg comprising a second upper leg portion and a second lower leg portion that slides within the second upper leg portion in a telescopic arrangement, the second lower leg portion having second notches that correspond to the multiple selectable height positions;

a cross-brace tube laterally disposed between and connecting the first upper leg portion of the first telescopic leg and the second upper leg portion of the second telescopic leg;

a height adjustment mechanism disposed within the cross-brace tube, the height adjustment mechanism comprising:

a first latch arm that is operable to slide between a first position and a second position, the first latch arm having an inner end and an outer end, the first latch arm including a first tab disposed at the outer end and a first sloped surface disposed adjacent the inner end, wherein the first tab is operable toe engage one of the first notches on the first lower leg portion when the first latch arm is in the first position, and to disengage from the first notches on the first lower leg portion when the first latch arm is in the second position;

a second latch arm that is operable to slide between a first and second position, the second latch arm having an inner end and an outer end, the second latch arm including a second tab disposed at the outer end and a second sloped surface disposed adjacent the inner end, wherein the second tab is operable to engage one of the second notches on the second lower leg portion when the second latch arm is in the first position, and to disengage from the second notches on the second lower leg portion when the second latch is in the second position;

a spring disposed between and attached to the inner ends of the first and second latch arms, wherein the spring provides an outward force that urges the first and second latch arms laterally away from each other when the spring is compressed; and an activation device disposed adjacent the first and second sloped surfaces of the first and second latch arms, the activation device comprising:

a first contact surface that slidingly engages the first sloped surface, thereby causing the first latch arm to slide inward from the first position to the second position; and a second contact surface that slidingly engages the second sloped surface, thereby causing the second latch arm to slide inward from the first position to the second position.

10. The collapsible telescopic leg assembly of claim 9 wherein the first and second sloped surfaces are shaped such that a downward vertical displacement of the first and second contact surfaces in engagement with the first and second sloped surfaces causes the first and second latch arms to move inward in a lateral direction.

11. The collapsible telescopic leg assembly of claim 9 wherein the cross-brace tube acts as a guide in which the first and second latch arms slide between first and second positions.

12. The collapsible telescopic leg assembly of claim 9 further comprising a guide case attached to the cross-brace tube, wherein the guide case at least partially encloses and guides movement of the activation device and the first and second latch arms, and wherein the guide case limits motion of the activation device to only vertical motion and limits motion of the first and second latch arms is limited to only horizontal lateral motion.

13. The collapsible telescopic leg assembly of claim 12 further comprising one or more fasteners that secure the guide case to the cross-brace tube.

14. The collapsible telescopic leg assembly of claim 9 wherein the activation device comprises a molded plastic button having a substantially hollow interior.

15. The collapsible telescopic leg assembly of claim 9 wherein the first and second contact surfaces of the activation device comprise molded plastic surfaces disposed within the interior of the molded plastic button.

16. The collapsible telescopic leg assembly of claim 9 wherein the first and second contact surfaces of the activation device comprise cylindrical metal pins disposed within the interior of the molded plastic button.

17. A table comprising:

a tabletop;

a telescopic leg assembly having multiple selectable height positions, the telescopic leg assembly being pivotally connected to the tabletop and movable from a use position in which the telescopic leg assembly is perpendicular to the tabletop and a storage position in which the telescopic leg assembly is parallel to the tabletop, the telescopic leg assembly comprising:

a first telescopic leg comprising a first upper leg portion and a first lower leg portion that slides within the first upper leg portion in a telescopic arrangement, the first lower leg portion having first notches that correspond to the multiple selectable height positions;

a second telescopic leg comprising a second upper leg portion and a second lower leg portion that slides within the second upper leg portion in a telescopic arrangement, the second lower leg portion having second notches that correspond to the multiple selectable height positions;

a cross-brace tube laterally disposed between and connecting the first upper leg portion of the first telescopic leg and the second upper leg portion of the second telescopic leg; and a height adjustment mechanism disposed within the cross-brace tube, the height adjustment mechanism comprising:

a first latch arm that is operable to slide between a first position and a second position, the first latch arm having an inner end and an outer end, the first latch arm including a first tab disposed at the outer end and a first sloped surface disposed adjacent the inner end, wherein the first tab is operable to engage one of the first notches on the first lower leg portion when the first latch arm is in the first position, and to disengage from the first notches on the first lower leg portion when the first latch arm is in the second position;

a second latch arm that is operable to slide between a first and second position, the second latch arm having an inner end and an outer end, the second latch arm including a second tab disposed at the outer end and a second sloped surface disposed adjacent the inner end, wherein the second tab is operable to engage one of the second notches on the second lower leg portion when the second latch arm is in the first position, and to disengage from the second notches on the second lower leg portion when the second latch is in the second position;

a spring disposed between and attached to the inner ends of the first and second latch arms, wherein the spring provides an outward force that urges the first and second latch arms laterally away from each other when the spring is compressed; and an activation device disposed adjacent the first and second sloped surfaces of the first and second latch arms, the activation device comprising:

a first contact surface that slidingly engages the first sloped surface, thereby causing the first latch arm to slide inward from the first position to the second position; and a second contact surface that slidingly engages the second sloped surface, thereby causing the second latch arm to slide inward from the first position to the second position.

* * * * *